US010253539B2

(12) United States Patent
Kaiser et al.

(10) Patent No.: US 10,253,539 B2
(45) Date of Patent: Apr. 9, 2019

(54) PIVOTING FITTING

(71) Applicant: HETTICH HOLDING GMBH & CO. OHG, Kirchlengern (DE)

(72) Inventors: Andre Kaiser, Bielefeld (DE); Andreas Montecchio, Bad Salzuflen (DE)

(73) Assignee: HETTICH HOLDING GMBH & CO. OHG, Kirchlengern (DE)

( * ) Notice: Subject to any disclaimer, the term of this patent is extended or adjusted under 35 U.S.C. 154(b) by 0 days.

(21) Appl. No.: 15/551,311

(22) PCT Filed: Feb. 15, 2016

(86) PCT No.: PCT/EP2016/053179

§ 371 (c)(1),
(2) Date: Aug. 16, 2017

(87) PCT Pub. No.: WO2016/131780

PCT Pub. Date: Aug. 25, 2016

(65) Prior Publication Data

US 2018/0016829 A1 Jan. 18, 2018

(30) Foreign Application Priority Data

Feb. 19, 2015 (DE) ..... 10 2015 102 393

(51) Int. Cl.
*E05F 1/08* (2006.01)
*E05F 1/12* (2006.01)
(Continued)

(52) U.S. Cl.
CPC ..... *E05F 1/1276* (2013.01); *E05D 3/14* (2013.01); *E05D 11/10* (2013.01); *E05F 1/1075* (2013.01);
(Continued)

(58) Field of Classification Search
CPC ..... Y10T 16/5383; Y10T 16/53832; Y10T 16/53833; Y10T 16/53834; Y10T 16/585;
(Continued)

(56) References Cited

U.S. PATENT DOCUMENTS 2,626,420 A * 1/1953 Mongin ..... E05F 1/1253 16/79
3,088,727 A * 5/1963 Pelagatti ..... E05F 11/382 74/103
(Continued)

FOREIGN PATENT DOCUMENTS

DE 2653106 A1 * 5/1978 ..... E05C 17/32
DE 3124457 A1 * 12/1982 ..... E05B 65/0046
(Continued)

OTHER PUBLICATIONS

International Search Report of PCT/EP2016/053179 dated Mar. 29, 2016.
(Continued)

*Primary Examiner* — Chuck Y Mah
(74) *Attorney, Agent, or Firm* — Barnes & Thornburg LLP

(57) ABSTRACT

A pivoting fitting for pivoting a flap hinged on a furniture body, comprising an energy accumulator fastened to a connecting part which can be connected to a body wall, and a lever arrangement which is operatively connected to the energy accumulator and has at least one articulated lever, is configured such that the energy accumulator is connected to a control element comprising a cam disc which is fixed but rotatable with respect to the connecting part, which control element is connected in a movement-dependent manner to the articulated lever which is held on the one side on the connecting part and can be held on the other side on the flap, and is rotated when the articulated lever is pivoted, wherein in one pivoted end position, the energy accumulator is
(Continued)

clamped, and in the other end position is unclamped relative thereto, and wherein the cam disc has a control contour with varying radius of curvature, on which cam disc the energy accumulator is held.

12 Claims, 2 Drawing Sheets

(51) Int. Cl.
*E05F 1/10* (2006.01)
*E05D 3/14* (2006.01)
*E05D 11/10* (2006.01)

(52) U.S. Cl.
CPC ... *E05Y 2201/488* (2013.01); *E05Y 2201/638* (2013.01); *E05Y 2201/644* (2013.01); *E05Y 2201/71* (2013.01); *E05Y 2201/712* (2013.01); *E05Y 2900/20* (2013.01)

(58) Field of Classification Search
CPC .. Y10T 16/299; E05F 1/08; E05F 1/10; E05F 1/1041; E05F 1/1091; E05F 1/12; E05F 1/1223; E05F 1/1246; E05F 1/1253; E05F 1/1261; E05F 1/1292; E05F 1/14; E05F 1/1276; E05F 1/1269; E05F 1/1075; E05D 11/1021; E05D 3/12; E05D 3/14; E05D 3/16; E05D 15/40; E05D 15/401; E05D 15/405; E05D 15/406; E05D 15/42; E05D 15/58; E05D 15/565; E05D 3/04; E06B 3/5045; E05Y 2800/22; E05Y 2900/20; E05Y 2900/202; E05Y 2900/208; E05Y 2900/21; E05Y 2201/21; E05Y 2201/264; E05Y 2201/448; E05Y 2201/638; E05Y 2201/644; E05Y 2201/654; E05Y 2201/71; E05Y 2201/712
See application file for complete search history.

(56) References Cited

U.S. PATENT DOCUMENTS 3,715,931 A * 2/1973 Littmann ..... F16H 35/10 49/342
3,906,587 A * 9/1975 Little ..... E05F 1/1261 16/289
3,999,245 A * 12/1976 Bue ..... A47C 17/40 16/289
4,601,446 A * 7/1986 Opsahl ..... B64C 1/1415 16/289
4,768,762 A 9/1988 Lund
5,896,619 A * 4/1999 Koopman ..... E05F 1/1253 16/286
5,904,411 A * 5/1999 Hayakawa ..... E05D 15/582 16/289
7,127,778 B2 * 10/2006 Salice ..... E05F 5/006 16/354
7,178,202 B2 * 2/2007 Hirtsiefer ..... E05D 3/14 16/286
8,042,891 B2 * 10/2011 Tynes ..... A47L 15/4261 312/228
8,256,064 B2 * 9/2012 Blersch ..... E05D 3/18 16/286
8,468,653 B2 * 6/2013 Tumler ..... E05D 11/10 16/286
8,590,990 B2 * 11/2013 Friesenecker ..... E05F 15/63 16/286
8,894,162 B2 * 11/2014 Kashiwaguma ..... E05F 1/1058 312/319.2
2001/0039762 A1 * 11/2001 Giovannetti ..... E05F 1/1091 49/246
2004/0239213 A1 * 12/2004 Hirtsiefer ..... E05D 15/262 312/109
2005/0218383 A1 10/2005 Hirtsiefer et al.
2006/0174444 A1 8/2006 Giovannetti
2007/0124893 A1 * 6/2007 Brustle ..... E05F 1/1075 16/296
2008/0121490 A1 * 5/2008 Dubach ..... E05F 1/1058 192/17 D
2010/0162847 A1 * 7/2010 Gassner ..... E05F 1/1058 74/490.07
2011/0193458 A1 8/2011 Omann
2012/0084944 A1 * 4/2012 Hirtsiefer ..... E05D 3/14 16/302

FOREIGN PATENT DOCUMENTS

DE 29605551 5/1996
DE 202005016375 12/2005
DE 602006000965 6/2009
EP 1999328 12/2008
WO 03/097973 11/2003
WO 2007112800 10/2007
WO WO-2007112800 A1 * 10/2007 ..... E05D 15/262
WO 2010/051569 5/2010

OTHER PUBLICATIONS

English translation of International Search Report of PCT/EP2016/053179 dated Mar. 29, 2016.
Search Report issued in German Application No. 102015102393.8 dated Nov. 17, 2015.

* cited by examiner

PIVOTING FITTING

CROSS REFERENCE TO RELATED APPLICATIONS

This application is a U.S. nationalization under 35 U.S.C. § 371 of International Application No. PCT/EP2016/053179, filed Feb. 15, 2016, which claims priority to German Application No. 102015102393.8 filed Feb. 19, 2015.

BACKGROUND AND SUMMARY OF THE DISCLOSURE

The present disclosure relates to a pivoting fitting for pivoting a flap, which is hinged on a furniture body.

Such pivoting fittings are used in order to automatically keep the flap pivoted about a horizontal axis in the open position on the one hand and to secure it in a closed position on the other hand, for which purpose it is pulled against the associated edges of the furniture body by the force of an energy accumulator, usually a tension spring.

Such a pivoting fitting is discussed in DE 296 05 551 U1. In this case, an energy accumulator formed as a tension spring engages on a lever arrangement, which is fastened on the one hand to a body wall and on the other hand to the flap, wherein the tension spring holds the flap both in an unfolded position and also pulls it in a closed position to the furniture body.

However, it is a problem in this case that, during pivoting of the flap, the flap must be guided manually in order to hold it against the force of the tension spring, which tends to pull the flap to a closed position, except when in the open position in which, as mentioned, the flap is held by the tension spring.

The handling during the pivoting of the flap is also problematic in that it is pulled in an almost unbraked manner to its closed position, so that it is pressed against the furniture body with a largely undiminished tensile force.

In order to provide a remedy, the use of a damping device has been proposed in DE 20 2005 016 375, with which the closing process or the striking of the flap on the furniture body is dampened.

Irrespective of the fact that the holding problem is not solved during pivoting, the known pivoting fittings can only be implemented with a large number of components, in particular with regard to necessary lever kinematics, which not only leads to considerable production costs but also makes mounting of the respective pivoting fitting more difficult.

A different design is also to be considered disadvantageous, in particular also with regard to sufficient service life, with which, as it were, a forced guidance of the flap is to be achieved and in which a cam is used in correspondence with a control cam, wherein the cam is spring-loaded.

Due to the necessarily high spring forces, the components involved in the movement sequence are subject to relatively high friction and high surface pressure, which can lead to damage to the control contour of the cam or to a roller guided thereon. This is obviously unacceptable, especially since the pivoting fitting is then impaired in its function and must be replaced at worst.

A new pivoting fitting according to the present disclosure may have relatively few components compared to a pivoting fitting according to the prior art. This results in low production costs, both as a result of economical use of materials as well as by shorter production times, which is important in so far as such pivoting fittings are used as serial articles in large quantities.

In an embodiment, a lever arrangement is formed by a four-bar chain known per se, the movement of which is supported by the control element in correspondence with the energy accumulator. In principle, however, all other lever arrangements can also be supported with the system.

In this case, the force of the energy accumulator, for example, a tension spring or a tension spring block, is applied by the control element to the lever arrangement, i.e. the articulated lever, in such a way that the flap remains automatically in a predetermined range of the pivoted position, i.e. it remains in equilibrium. In a pivoting range before the fully closed position or in a pivoting range of the fully open position, the flap can close or open automatically.

In an embodiment, the control element has a rotatable cam disk, having a control contour, on which a flexible traction means rests, the flexible traction means being attached to the cam disk and forming an extension of the energy accumulator.

In this case, the connection of the traction means, which may otherwise include a belt, a chain, a toothed belt, a cable or the like, can take place on the cam disk in such a way that the force direction of the energy accumulator in the closed position of the flap, relative to the pivoting direction, is positioned above the axis of a pivot pin carrying the control element and below in the open position, as a result of which the respective different rotational directions of the control element are supported.

This arrangement may provide for assistance with that the pivoting movement when the flap is pivoted, just before reaching the respective end position.

In an embodiment, the control element has, in addition to the cam disk, at least one further gear part which may be a pinion which is held in a rotationally fixed manner relative to the cam disk. This pinion cooperates with further gear elements, preferably with a toothed wheel segment which is fixedly connected to the articulated lever. In this case, the pinion and the cam disk can be pivoted about a common axis of rotation, which is formed by a pivot pin held on one side. Two opposing pivot pins are preferably provided, the axes of rotation of which are aligned and which are disposed at a distance from one another on the front side, wherein the pinion is mounted on one pivot pin and the cam disk on the other.

As mentioned, the new pivoting fitting enables the flap to remain in each intermediate pivoting position without support. For this purpose, the radius of curvature of a control cam of the cam disk varies in the course of the curve, which is adjusted to the torques which change depending on the pivoting position of the flap and act on the cam disk or the energy accumulator. In this case, the torque which is different in each pivoting position of the flap is essentially determined by the weight of the flap and the changing lever arm, resulting from the varying distance of the control contour from the axis of rotation of the control element.

DETAILED DESCRIPTION OF THE DRAWINGS

Figure 1:
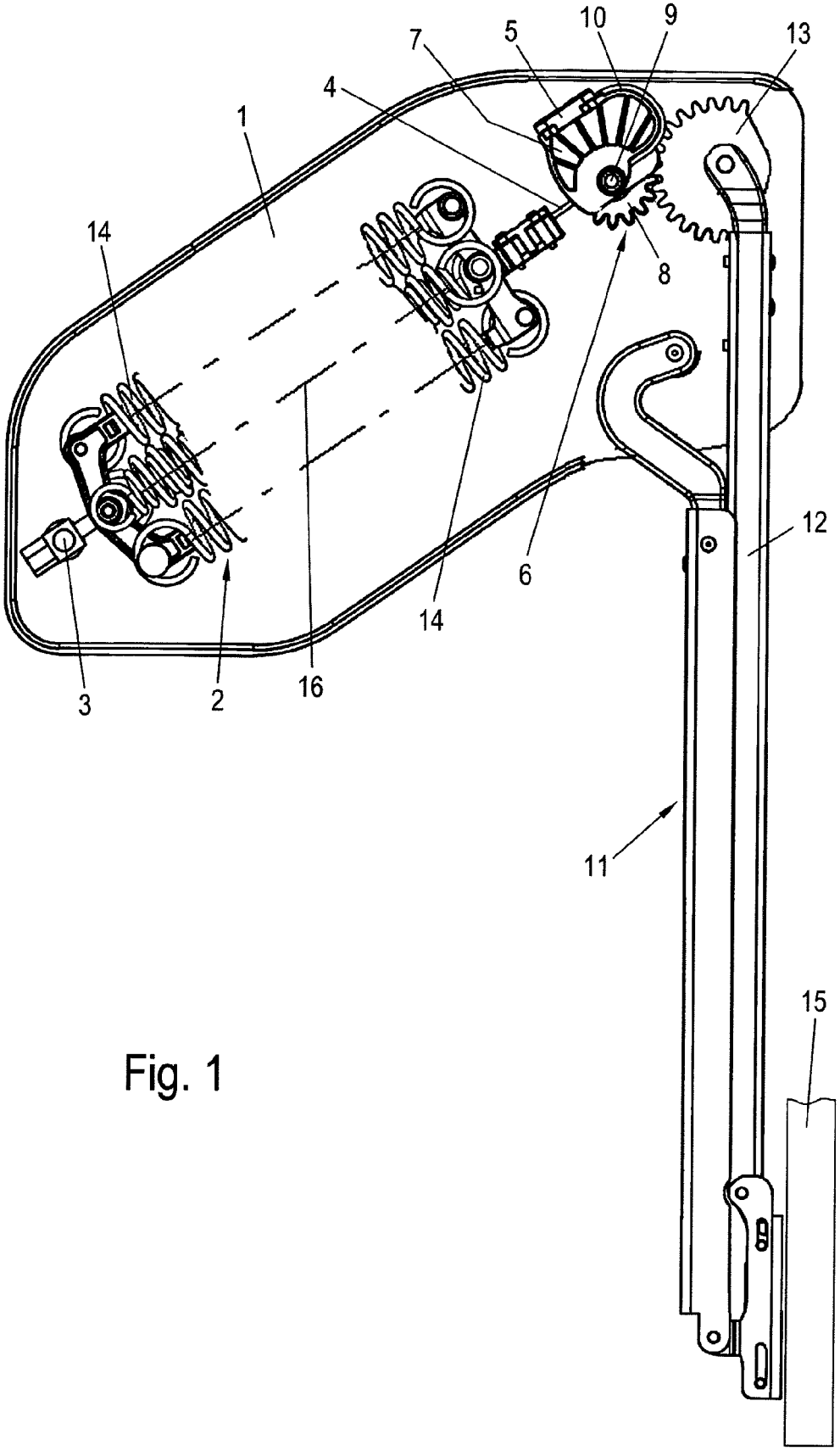
FIGS. 1 and 2 show a pivoting fitting according to the invention in different positions in respective side views.

A pivoting fitting for pivoting a flap 15, which is hinged on a furniture body (not shown), is shown in the drawings, wherein a part of the functional parts of the pivoting fitting is arranged in a housing, which forms a connecting part, on a body wall of the furniture body, and of which a housing part 1 is shown.

By omitting the body wall, on which the housing is fastened, and a further housing part, the drawings virtually provide a view from the outside into the furniture body and the housing, wherein a pivot pin 9 is arranged to be fixed on one side to the housing part (not shown).

An energy accumulator 2 is held in the housing so as to be pivotable about a pivot axis 3 and thus fixed in a stationary manner, i.e. indirectly, to the body wall (not shown).

Said energy accumulator 2 consists in this example of a spring block with three tension springs 14 arranged parallel to one another and is connected to a control element 6 via a centrally connected traction means 4, wherein the traction means 4 forms the extension of an effective axis 16 of the energy accumulator 2. Instead of the tension springs 14, other suitable energy accumulators can also be used, e.g. a compression spring with deflection, torsion springs, roller springs or the like.

The control element 6 is rotatable but also stationary relative to the housing and is connected, in a manner dependent on the movement, to an articulated lever 12 of a lever arrangement 11, wherein the lever arrangement 11 is formed as a four-bar chain and the articulated lever 12 is held on the flap 15 on the one hand and pivotably in the housing on the other hand.

The control element 6 has a cam disk 7 as well as a pinion 8, which are mounted on the pivot pin 9 in a rotationally fixed manner with respect to each other.

The traction means 4 rests on a control contour 10 of the cam disk 7 and is fastened thereto by means of a connecting element 5.

The pinion 8, in turn, engages in the teeth of a gearwheel segment 13, which is connected in a rotationally fixed manner to the articulated lever 12, specifically in the region of its pivot axis in the housing.

FIG. 1 shows a closed position of the flap 15. During its pivoting in the direction of an open position shown in FIG. 2, in which the flap 15 is displaced in parallel, the articulated lever 12 is twisted, as also the control element 6, in the pinion 8 of which the teeth of the gearwheel segment 13 engage. The energy accumulator 2 is in the closed position, i.e. the tension springs 14 are tensioned.

In this case, the traction means 4, which is fastened to the cam disk 7 via a connecting element 5, is located above the axis of the pivot pin 9, as seen in the pivoting direction of the articulated lever 12, so that the pinion 8 is loaded in the counterclockwise direction, by means of which the gearwheel segment 13 is rotated clockwise during closure of the flap 15 and pressed against the furniture body.

When the flap 15 is pivoted in the upward direction, the control element 6 is rotated in the opposite direction, i.e. clockwise. As a result of the tensile force of the energy accumulator 2 and the geometry of the cam disk, i.e. as a result of the course of the control contour 10, and with a change in the distance from the axis of the pivot pin 9, the speed of the travelled path of the energy accumulator changes with constant angular speed of the lever arrangement 11.

In each position of the lever arrangement 11 or of the flap 15, the varying torque, resulting from the tensile force of the energy accumulator 2 and the distance of the control contour 10 from the pivot pin 9, therefore ensures the support-free holding of the flap 15.

Figure 2:
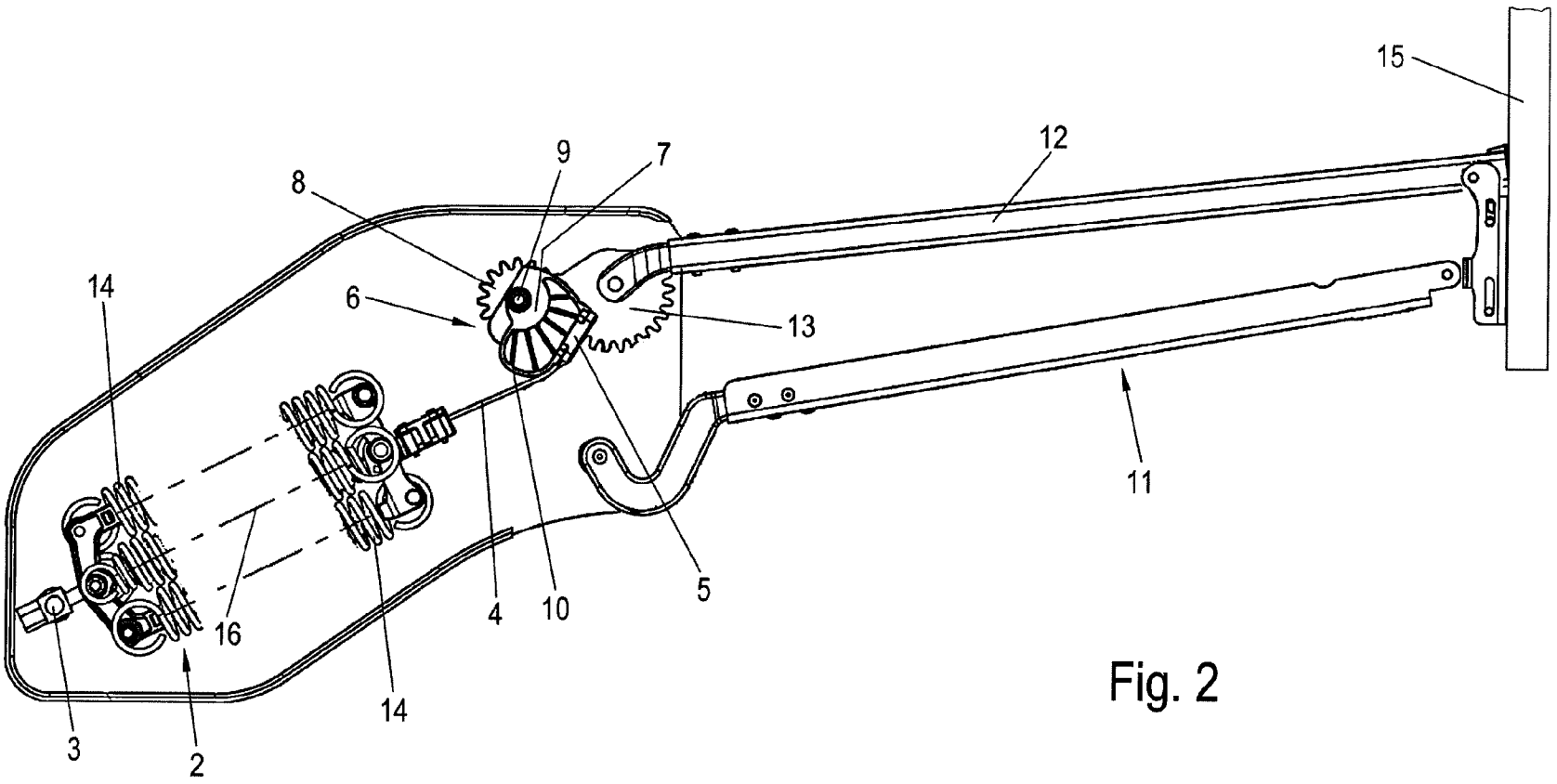

As can be seen particularly clearly in FIG. 2, the traction means 4 now lies against the pivot pin 9 on the side of the cam disk 7 which is the lower one in the pivoting direction, i.e. opposite the position in the closed position of the flap 15.

It can be clearly seen that, in the closed position of the flap 15 (FIG. 1), the energy accumulator 2 is tensioned while it is relatively relaxed in the opening position of the flap 15 (FIG. 2). At the same time, the effective axis 16 is changed in its position relative to the axis of rotation of the pivot pin 9.

As a result of the one-sided holding of the pivot pin 9 in the sense of a lifting lug, the traction means 4 can be guided without hindrance into the respective end position by twisting the cam disk 7

The invention claimed is:

1. A pivoting fitting for pivoting a flap hinged on a furniture body, the pivoting fitting comprising:

a housing configured for connection to a wall of the furniture body;

a control element rotatably mounted to the housing, the control element comprising a cam disk and a pinion mounted to the cam disk for rotation with the cam disk;

an energy accumulator fastened to the housing and connected to the control element by a connector;

a lever arrangement comprising at least one articulated lever, the at least one articulated lever pivotably connected to the housing, the lever arrangement comprising a gear part engaged with the pinion, the at least one articulated lever configured for connection to the flap, and the at least one articulated lever pivotable between a first end position and a second end position;

wherein the control element is rotated in response to pivoting of the at least one articulated lever, wherein the energy accumulator is tensioned when the at least one articulated lever is rotated to the first end position;

wherein the energy accumulator is relaxed when the at least one articulated lever is rotated to the second position;

wherein the cam disk has a control contour with a varying radius of curvature, the connector selectively engageable with the control contour.

2. A pivoting fitting according to claim 1, wherein the gear part comprises a gearwheel segment rotationally fixed to the articulated lever for rotation with the at least one articulated lever, and wherein the pinion is engaged with the gearwheel segment.

3. A pivoting fitting according to claim 1, wherein at least one of the pinion and the cam disk is rotatably mounted on a pivot pin fixed to the housing.

4. A pivoting fitting according to claim 3, wherein the control contour is configured so that the connector extends on one side of the axis of the pivot pin when the articulated lever is in one pivoted end position and on the other side of the axis of the pivot pin when the articulated lever is in another pivoted end position.

5. A pivoting fitting according to claim 4, wherein the energy accumulator maintains the flap in a first pivoted position when the connector extends on one side of the pivot pin and wherein the energy accumulator maintains the flap in a second pivoted position when the connector extends on the other side of the pivot pin.

6. A pivoting fitting according to claim 1, wherein the connector is flexible.

7. A pivoting fitting according to claim 1, wherein the connector rests against the control contour of the cam disk.

8. A pivoting fitting according to claim 1, wherein the energy accumulator is pivotably mounted to the housing.

9. A pivoting fitting according to claim 1, wherein the control contour directs the torque generated by the energy accumulator on the control element in a first direction when the flap is closed and in a second direction when the flap is open.

10. A pivoting fitting according to claim 1, wherein the control contour holds the flap in equilibrium in at least one position between a fully open position and a fully closed position.

11. A pivoting fitting according to claim 1, wherein the lever arrangement further comprises a second articulated lever pivotably connected to the housing, a link pivotably connected to the at least a first articulated lever and to the second articulated lever, the at least a first articulated lever, the second articulated lever, the link, and the housing cooperating to define a four-bar chain.

12. A pivoting fitting according to claim 1, wherein the energy accumulator comprises at least one tension spring.

* * * * *